United States Patent [19]

Hurt et al.

[11] Patent Number: 4,480,758

[45] Date of Patent: Nov. 6, 1984

[54] RAILWAY COUPLER ARRANGEMENT

[75] Inventors: Alvin G. Hurt, Pittsburgh; Lynn K. Tilly, Allison Park, both of Pa.

[73] Assignee: McConway & Torley Corporation, Pittsburgh, Pa.

[21] Appl. No.: 438,581

[22] Filed: Nov. 3, 1982

[51] Int. Cl.[3] ..... B61G 7/10

[52] U.S. Cl. ..... 213/54; 213/7; 213/59; 213/66

[58] Field of Search ..... 213/7, 50, 51, 54, 58, 213/59, 62 A, 64, 66, 8

[56] References Cited

U.S. PATENT DOCUMENTS 3,559,818 2/1971 Knippel et al. ..... 213/54 X
3,583,573 6/1971 Knippel et al. ..... 213/54 X

FOREIGN PATENT DOCUMENTS 1066058 6/1954 France ..... 213/7
1029368 5/1966 United Kingdom ..... 231/50

*Primary Examiner*—Randolph Resse
*Attorney, Agent, or Firm*—Thomas H. Murray; Clifford A. Poff

[57] ABSTRACT

A railway coupler arrangement which eliminates the conventional yoke strap, thereby enabling a larger draft gear to be employed in the coupling without increasing the overall size of the sill. The invention also provides a novel assembly for facilitating a rotary coupler arrangement in which the diameter of the rotary shank can be increased over prior art rotary butt couplers.

5 Claims, 10 Drawing Figures

RAILWAY COUPLER ARRANGEMENT

BACKGROUND OF THE INVENTION

In a conventional railway coupler arrangement, the coupler head is connected through a shank to a yoke having a yoke strap which envelops a draft gear (i.e., a spring arrangement which absorbs shock loads). The draft gear, in turn, is carried within a sill which is secured to the car body and is provided with front and rear draft lugs between which the draft gear can slide. During draft loads (i.e., pulling loads), the yoke strap forces the draft gear against the front draft lugs and compresses the draft gear. During buff loads (i.e., pushing loads), the yoke pushes the draft gear against the rear draft lugs, again compressing it, but in the opposite sense.

In certain cases, it is desirable to provide a rotary coupler which permits an entire hopper car, for example, to be rotated and turned upside-down to discharge its contents without decoupling it from forward and aft cars. Many types of rotary couplers have been devised as exemplified by U.S. Pat. Nos. 3,104,017 and 4,090,614. In many of these designs, problems have been encountered because of the limited area available for the rotary connection between the front draft lugs. Other designs utilize the space at the coupler head to obtain adequate room for the rotary connection. In either case, design constraints either limit the diameter of the rotary shank or butt area (which are critical factors), or involve other drawbacks.

SUMMARY OF THE INVENTION

In accordance with the present invention, a new and improved railway coupler arrangement is provided wherein the conventional yoke and draft gear arrangement is modified. This enables a larger draft gear to be positioned within the sill and reduces the cost of the casting which forms the yoke.

Further, in accordance with the invention, a new and improved rotary coupler arrangement is provided wherein the rotary connection is positioned just aft of the front draft lugs on a sill or striker. This arrangement permits at least a 6½ inch diameter rotary shank as well as a two-inch wide shoulder bearing area for the rotary connection. This is in contrast to prior art rotary coupler arrangements of this type wherein the diameter of the shank is ordinarily less than 5¾ inches, giving rise to possible field failures.

Specifically, there is provided a railway coupler arrangement comprising a center sill having front and rear draft lugs within the sill. A draft gear housing is carried within the sill and is slideable between the front and rear draft lugs. A follower and plunger block is slideable in the center sill and is in engagement with one end of a draft gear carried within the draft gear housing. A yoke shank extends into the draft gear housing and is provided with a butt engageable with the aforesaid follower and plunger block and is movable from a position where it engages forward wall means on the draft gear housing during draft loads to a position removed from the forward wall means where it forces the follower and plunger block into the draft gear during buff loads. Means are associated with the front draft lugs for engaging the follower and plunger block during draft loads to compress the draft gear.

With an arrangement of this sort, the conventional yoke strap is eliminated, and the draft gear area can be maximized. The means for engaging the follower and plunger block during draft loads preferably comprises keys which extend between the front draft lugs and are engageable with the follower and plunger block during draft loads as the draft gear housing moves forwardly. As the housing does move forwardly, the keys restrain the follower and plunger block to compress the draft gear and provide a cushioning effect.

Further, in accordance with the invention, a rotary coupler arrangement is provided wherein the railway coupler shank is provided with a butt end which extends into the draft gear housing and which is engageable with a cooperating spherical surface on the follower and plunger block. With an arrangement of this sort, the rotary coupler butt end is disposed aft of the front draft gear lugs on the sills such that its diameter may be maximized.

The above and other objects and features of the invention will become apparent from the following detailed description taken in connection with the accompanying drawings which form a part of this specification, and in which.

Figure 2:
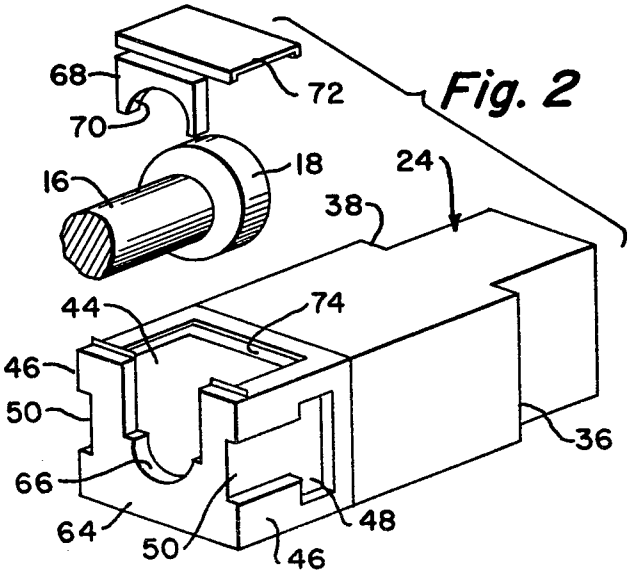
FIG. 2 is an exploded view of the draft gear housing and yoke of the invention.
Figure 1:
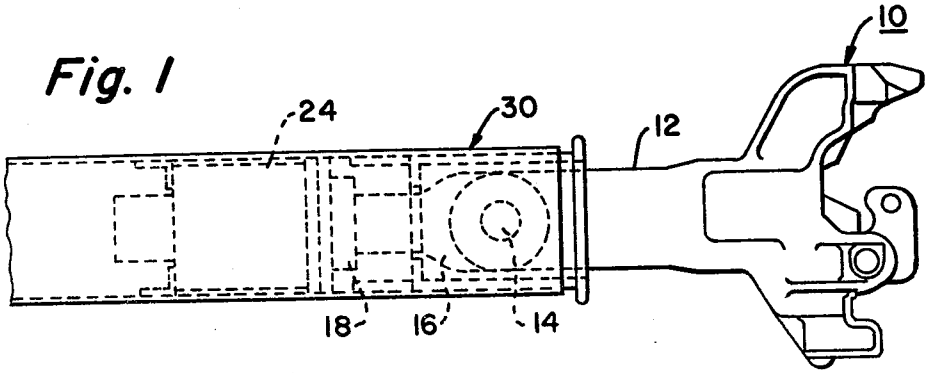
FIG. 1 is a top view of a railway coupler assembly incorporating the invention.
Figure 3:
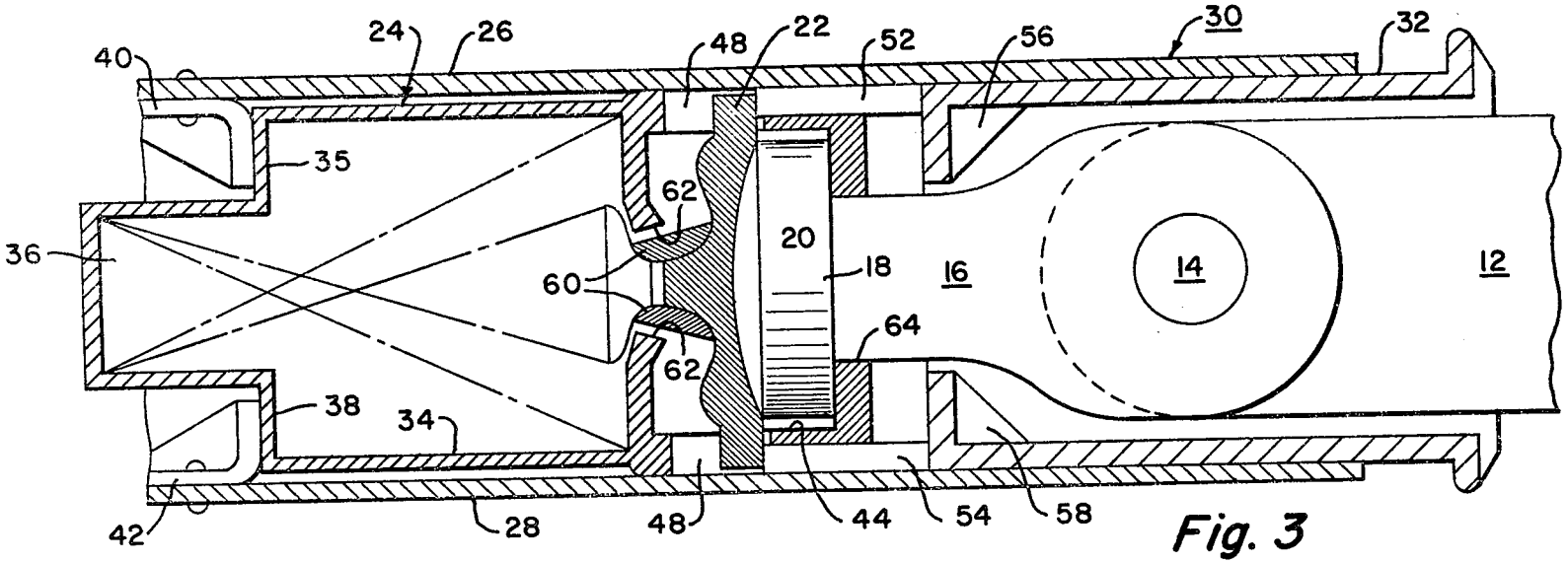
FIG. 3 is a top cross-sectional view of the invention showing the yoke and the draft gear when essentially no load is imposed on the coupler.

With reference now to the drawings, and particularly to FIGS. 1–3, a railway coupler head 10, provided with a shank 12, is pivotally connected at 14 to the modified yoke 16 of the invention. It should be understood, however, that a key-slotted or E-type coupler design can be incorporated into the invention as well as the pin-connected or F-type coupler shown herein. As is perhaps best shown in FIGS. 2 and 3, the yoke 16 is circular in cross-sectional configuration and does not include a conventional yoke strap. Rather, the cylindrical yoke 16 terminates in a rotary butt 18 having a rear spherical face 20 (FIG. 4) which is adapted to seat on a corresponding spherical surface 21 formed in a transversely-extending follower and plunger block 22.

The butt 18 and plunger block 22 are carried within the forward portion of a draft gear housing 24 slideable within the side walls 26 and 28 of a center sill 30 secured to the underside of a railway car in accordance with conventional practice. Received within the forward end of the sill 30 is a striker 32, as is conventional.

The details of the draft gear housing 24 are perhaps best shown in FIGS. 2 and 3. It includes a cavity 34 within which is received a draft gear 36 (FIG. 3) which is essentially a spring-type shock absorber in accordance with conventional practice. Laterally-extended surfaces 35 and 38 on the housing 34 are adapted to abut near draft lugs 40 and 42 carried on the insides of the sill walls 26 and 28. At the forward end of the housing 24 is a cavity 44 within which the butt 18 and follower and plunger 22 are disposed. The cavity 44 is formed by top and bottom walls and side walls 46 each of which is provided with an elongated opening 48 through which an end of the follower 22 extends. The openings 48, in turn, communicate with slots 50 which, as shown in FIG. 3, receive keys 52 and 54. The keys 52 and 54 engage front draft lugs 56 and 58 formed on the trailing end of the striker 32. The follower 22 is provided with wedges 60 which engage cooperating cam surfaces 62 formed on the forward inner periphery of the housing 34 which receives the draft gear 36.

Reverting to FIG. 2, the cavity 44 of the draft gear housing 24 includes a front wall 64 formed with a slotted, semi-circular opening 66 which receives the cylindrical shank 16. The shank is held in place by an upper block 68 formed with an upper semi-circular opening 70 which mates with the lower opening 66. The block 68 is secured to a cover plate 72 received within opening 74. The cover plate 72 can be held in place within the opening 74 by suitable fastening means, not shown.

Figure 4:
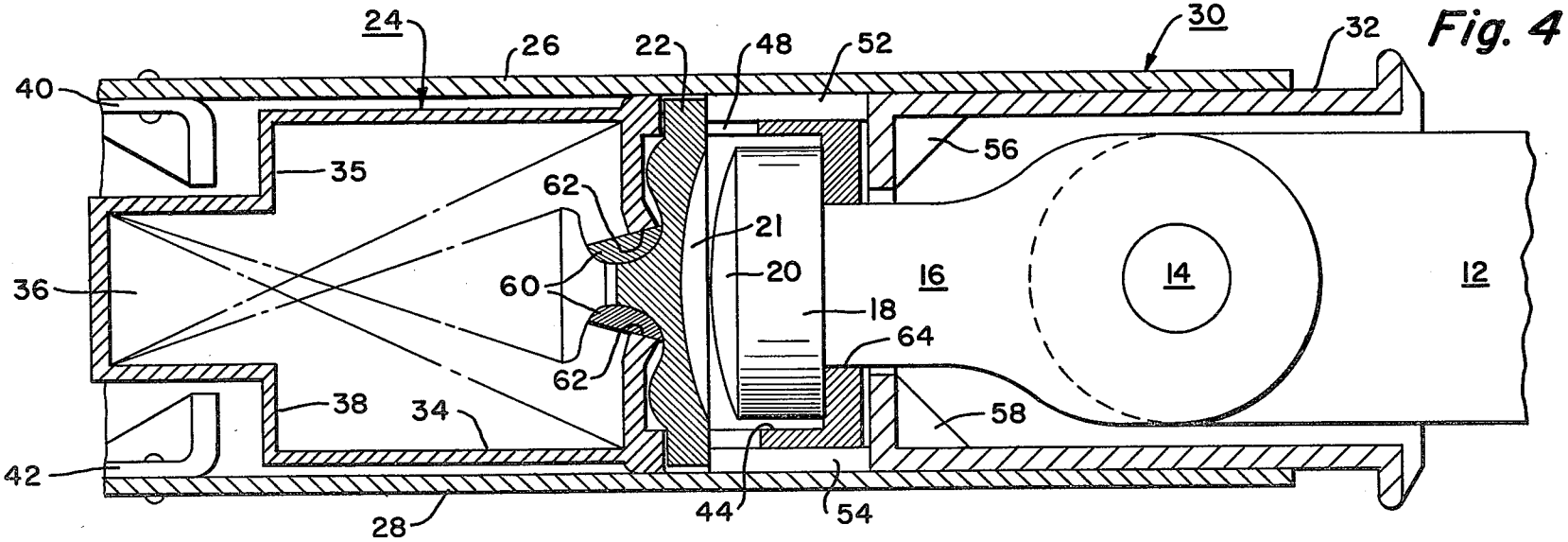
FIG. 4 is a view similar to that of FIG. 3 showing the positions of the parts when the coupler is under a draft load.

In FIG. 3, the various parts of the invention are shown when the coupler is under neither draft nor buff loads. Under these circumstances, the ends of the follower and plunger block 22 are essentially midway between the ends of the openings 48 while the draft gear 36 is essentially uncompressed. In FIG. 4, the parts are shown under draft load conditions. Under these circumstances, the butt engages the forward wall 64 of the draft gear housing 24 and pulls it forwardly such that the surfaces 35 and 38 of the draft gear housing disengage from the rear draft lugs 42 and 44 on the sill 30. By virtue of the keys 52 and 54 which engage the forward draft lugs 56 and 58, the follower and plunger block 22 cannot move forwardly with the draft gear housing 24. As a result, the draft gear 36, which attempts to move forwardly with the housing 24, is compressed, providing a cushioning effect during draft loads.

Figure 5:
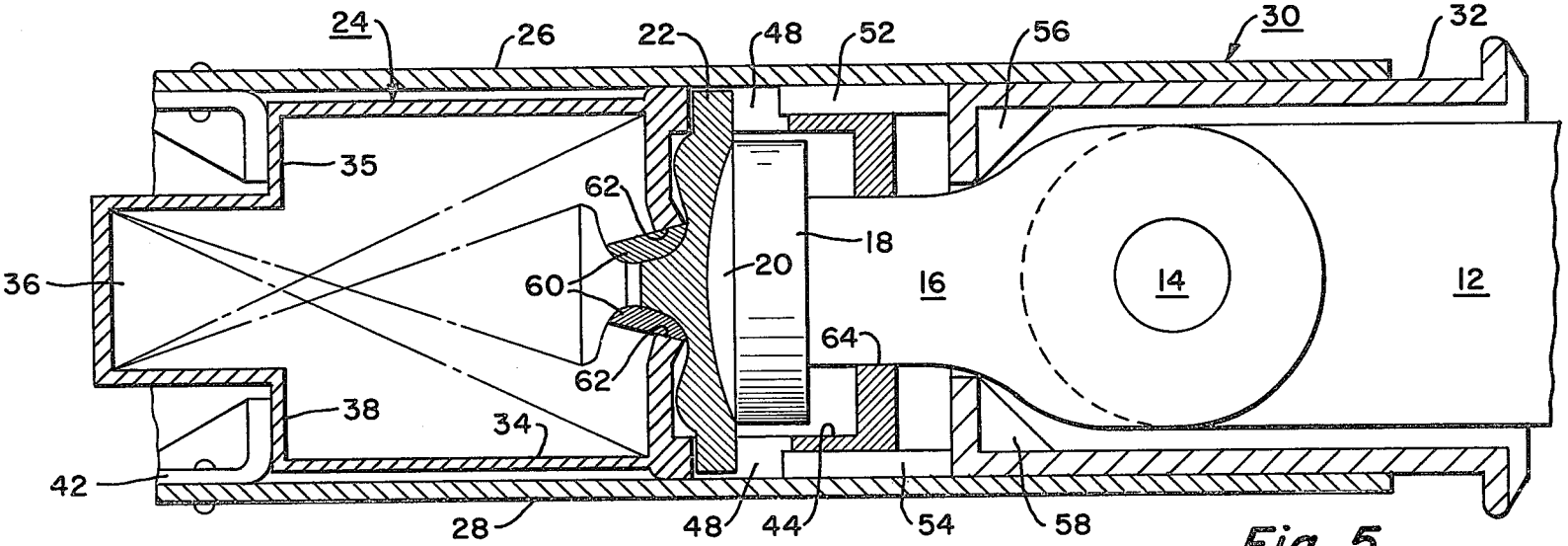
FIG. 5 is a view similar to FIG. 3 but showing the parts of the invention when the coupler is under a buff load.

In FIG. 5, the positions of the various parts during buff loading are shown. In this case, the surfaces 35 and 38 on the draft gear housing 24 engage the rear draft lugs 40 and 42 while the butt 18, under a buff load, forces the follower and plunger block 22 to the left to compress the draft gear 36.

Figures 6, 7, 8, 9, 10:
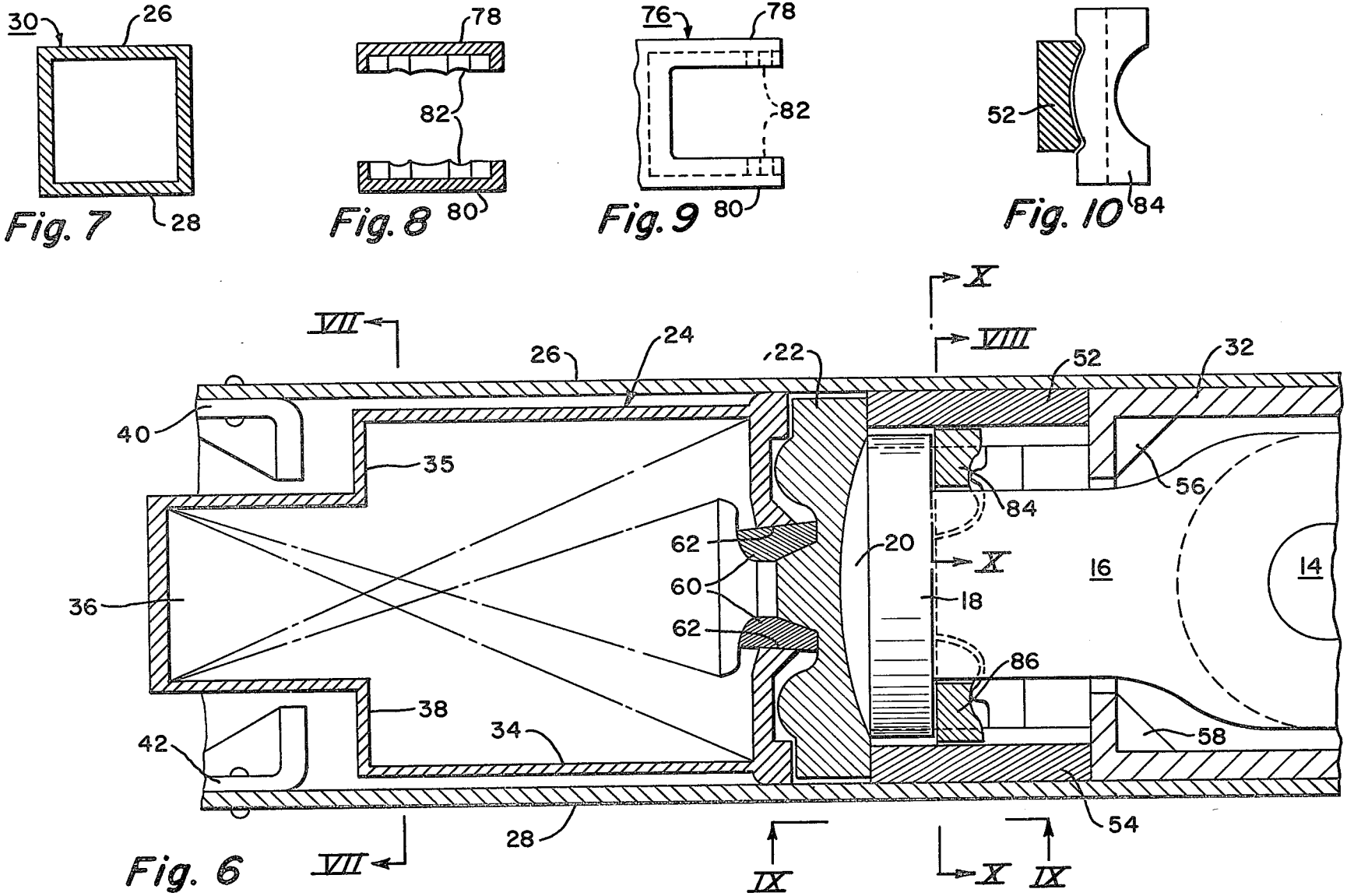
FIG. 6 is a cross-sectional view of another embodiment of the invention.
FIG. 7 is a cross-sectional view taken substantially along line VII—VII of FIG. 6.
FIG. 8 is a cross-sectional view taken substantially along line VIII—VIII of FIG. 6.
FIG. 9 is a side view of the front of the draft gear housing as viewed substantially along line IX—IX of FIG. 6.
FIG. 10 is a cross-sectional view taken substantially along line X—X of FIG. 6 showing the arrangement of the horizontal and vertical keys used in the embodiment of FIG. 6.

With reference now to FIGS. 6–10, another embodiment of the invention is shown wherein elements corresponding to those of FIGS. 1–6 are identified by like reference numerals In this case, however, the forward end of the draft gear housing (FIG. 9) is in the form of an open-sided and open-ended casting 76 having top and bottom walls 78 and 80. Formed in the top and bottom walls 78 and 80 are grooves or slots 82 which receive two vertical keys 84 and 86 (FIGS. 6 and 10) which are held in place by the spring force exerted on the follower 22 and butt 18 by the draft gear 36. Adjacent the keys 84 and 86 are horizontally-extending keys 52 and 54 corresponding to those shown in FIGS. 1–5. The operation of the embodiment of FIGS. 6–10 is the same as that of FIGS. 1–5. However, in assembling the embodiment of FIGS. 6–10, the rotary shank 16 and the butt 18 are inserted through the side of the draft gear housing between the upper and lower walls 78 and 80 just ahead of the follower and plunger block 22. The rotary shank is then compressed into the housing while compressing the draft gear 36. With the draft gear compressed, the vertical retention keys 84 and 86 are inserted in place. Finally, the longitudinally-running draft load keys 52 and 54 are inserted into the front corners of the draft gear housing. These keys, as shown in FIG. 6, bear against the follower and plunger block 22 and the front draft lugs 56 and 58.

With the arrangement shown, it is possible to rotate the entire railroad car about the axis of the yoke 18 and shank 12 with the spherical surface 20 on butt 18 sliding on the cooperating surface on the follower and plunger block 22.

It will be noted that in both embodiments of the invention, the draft gear 36 can extend between and beyond the rear draft lugs 40 and 42, thereby increasing the capacity of the draft gear for a given cross-sectional area within the sill 30. The height of the draft gear can also be increased due to the fact that a yoke strap is eliminated.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A railway coupler arrangement comprising a center sill, front and rear draft lugs within the sill, a draft gear housing having forward and aft wall means, said draft gear housing being carried within the sill and slideable between the front and rear draft lugs, a draft gear within the draft gear housing, a follower and plunger block slideable in said draft gear housing and in engagment with one end of the draft gear, a coupler yoke shank extending into said draft gear housing, a butt on said shank engageable with said follower and plunger block within the draft gear housing and movable from a position where it engages said forward wall means on the draft gear housing during draft loads to a position removed from the forward wall means where it forces the follower and plunger block into the draft gear during buff loads, the aft wall means of the draft gear housing engaging said rear draft lugs during buff loads, and means associated with said front draft lugs for engaging said follower and plunger block during draft loads to compress said draft gear.

2. The railway coupler arrangement of claim 1 wherein said draft gear housing extends between and beyond said rear draft lugs.

3. The railway coupler arrangement of claim 1 wherein the means associated with said front draft lugs for engaging said follower and plunger block comprises rigid longitudinally-extending keys which limit forward movement of said follower and plunger block during draft loads.

4. The railway coupler arrangement of claim 1 wherein said butt on said shank has a spherical surface engageable with a cooperating spherical surface on said follower and plunger block whereby said coupler yoke shank can rotate through 360° with respect to said center sill and vice versa.

5. The railway coupler arrangement of claim 4 wherein said spherical surfaces have peripheries extending through 360°.

* * * * *